US011639820B2

(12) United States Patent
Kirkman et al.

(10) Patent No.: US 11,639,820 B2
(45) Date of Patent: May 2, 2023

(54) SYSTEMS AND METHODS FOR MODELING OF CHILLER EFFICIENCY AND DETERMINATION OF EFFICIENCY-BASED STAGING

(71) Applicant: TRANE INTERNATIONAL INC., Davidson, NC (US)

(72) Inventors: Brian A. Kirkman, Shoreview, MN (US); Lee R. Cline, West Salem, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 302 days.

(21) Appl. No.: 17/130,937

(22) Filed: Dec. 22, 2020

(65) Prior Publication Data

US 2022/0196309 A1 Jun. 23, 2022

(51) Int. Cl.
*F25B 49/02* (2006.01)

(52) U.S. Cl.
CPC ..... *F25B 49/022* (2013.01); *F25B 2400/06* (2013.01); *F25B 2500/18* (2013.01); *F25B 2500/19* (2013.01); *F25B 2600/0251* (2013.01); *F25B 2600/0253* (2013.01); *F25B 2600/2513* (2013.01); *F25B 2700/2117* (2013.01)

(58) Field of Classification Search
CPC ..... F25B 49/022; F25B 2400/06; F25B 2500/19; F25B 2600/251; F25B 2600/0252; F25B 2600/0253; F25B 2400/07; F24F 11/46
See application file for complete search history.

(56) References Cited

U.S. PATENT DOCUMENTS

| | | | |
|---|---|---|---|
| 6,185,946 | B1 | 2/2001 | Hartman |
| 10,241,505 | B2 | 3/2019 | Cohen et al. |
| 10,527,306 | B2 | 1/2020 | Boettcher et al. |
| 10,852,716 | B2 | 12/2020 | Sayyarrodsari et al. |

(Continued)

OTHER PUBLICATIONS

Hydeman, "Development and Testing of a Reformulated Regression-Based Electric Chiller Model", American Society of Heating, Refrigerating and Air-Conditioning Engineers, Inc. Symposium, 10 pages (2002).

(Continued)

*Primary Examiner* — Jerry-Daryl Fletcher
*Assistant Examiner* — Daniel C Comings
(74) *Attorney, Agent, or Firm* — Hamre, Schumann, Mueller & Larson, P.C.

(57) ABSTRACT

Multi-compressor chiller systems can be efficiently operated by determining real time efficiency curves for the compressors currently in operation, along with any compressors that may be added to address demand, and using these efficiency curves to determine changes to compressor operation to improve efficiency in meeting chiller demand. The efficiency curves can be parabolic curves. The data used to determine the efficiency curves can be obtained through operation at a variety of lift points and a variety of load points within those lift points. The efficiency curves can be solved to find intersections where there may be staging points for adding or subtracting compressors from operation to efficiently meet demand. This operation can be automated through a controller of a control system for the multi-compressor chiller system.

20 Claims, 4 Drawing Sheets

(56) References Cited

U.S. PATENT DOCUMENTS

| | | | | |
|---|---|---|---|---|
| 10,921,972 | B2 | 2/2021 | Park et al. | |
| 2004/0144106 | A1* | 7/2004 | Douglas | F25B 49/02 62/186 |
| 2008/0163642 | A1* | 7/2008 | Okamoto | F25B 9/008 62/402 |
| 2013/0098084 | A1 | 4/2013 | Matsuo et al. | |
| 2017/0343267 | A1 | 11/2017 | Erpelding et al. | |
| 2019/0034066 | A1 | 1/2019 | Nayak et al. | |

OTHER PUBLICATIONS

Extended European Search Report; European Patent Application No. 21215076.7, dated May 16, 2022 (6 pages).

* cited by examiner

SYSTEMS AND METHODS FOR MODELING OF CHILLER EFFICIENCY AND DETERMINATION OF EFFICIENCY-BASED STAGING

FIELD

This disclosure is directed to systems and methods for modeling chiller efficiency in multi-chiller systems and controlling the chillers in use based on the modeled efficiency.

BACKGROUND

Chiller systems can include multiple working fluid circuits to provide cooling to the process fluid of the chiller, such as chilled water that is then used to provide cooling to a space. Each working fluid circuit includes a compressor. As cooling demand varies, the load on the compressors can vary and the number of compressors in use can also vary with demand. Compressor efficiency can change with compressor load and compressor lift (the difference in temperature or pressure between a condenser and an evaporator of the circuit including the compressor). The number of compressors needed to meet cooling demand therefore varies.

SUMMARY

This disclosure is directed to systems and methods for modeling chiller efficiency in multi-chiller systems and controlling the chillers in use based on the modeled efficiency.

Performing real-time modeling of compressor efficiency based on chiller demand and the resulting required lift and load can allow for compressor selection to account for the effects of lift and load on compressor efficiency. From the models of compressor efficiency, composite efficiency of the chiller system as a whole can be determined and compressor selection can be based on improving this composite efficiency, improving compressor selection and staging and thus providing increased efficiency for the chiller system.

In particular, using parabolic models for compressor efficiency for particular compressor lift states can simplify calculations while maintaining accuracy. This can enable real-time calculation of compressor efficiency and the models can be readily combined to determine the composite efficiency of a set of compressors being operated to meet a particular chiller demand. The parameters for these parabolic models can be based on observed compressor efficiency during a variety of lift and load conditions for each of the compressors.

In an embodiment, a method of operating a chiller system including a plurality of compressors includes receiving a chiller demand and determining a real time efficiency curve for each of the plurality of compressors of the chiller system that are currently in operation. The method further includes determining a capacity change operation based on the efficiency curves and a chiller demand and operating the chiller system according to the capacity change operation.

In an embodiment, the method further includes determining a real time efficiency curve for one or more compressors of the plurality of compressors that are not currently in operation. In an embodiment, the capacity change operation includes initiating operation of at least one of the one or more compressors of the plurality of compressors that are not currently in operation.

In an embodiment, the capacity change operation includes ceasing operation of at least one of the compressors of the chiller system that are currently in operation. In an embodiment, the capacity change operation includes changing a load of at least one of the compressors of the chiller system that are currently in operation.

In an embodiment, each of the real time efficiency curves is a parabolic function.

In an embodiment, determining the capacity change operation includes determining a composite efficiency curve based on the efficiency curves for each of the plurality of compressors of the chiller system that are currently in operation. In an embodiment, the composite efficiency curve is further based on an efficiency curve for at least one compressor of the chiller system that is not currently in operation.

In an embodiment, determining the capacity change operation includes solving for a staging point, wherein the staging point defines when to initiate operation of a compressor not currently in operation or when to cease operation of a compressor currently in operation.

In an embodiment, the method further includes obtaining selection data by measuring efficiency data for each of the plurality of compressors at each of a plurality of load points within each of a plurality of lift points, wherein determining the real time efficiency curves is based on the selection data.

In an embodiment, a control system for a chiller system including a plurality of compressors includes a controller. The controller is configured to receive a chiller demand and determine a real time efficiency curve for each of the plurality of compressors of the chiller system that are currently in operation. The controller further is configured to determine a capacity change operation based on the efficiency curves and a chiller demand and direct operation of the chiller system according to the capacity change operation.

In an embodiment, the controller is further configured to determine a real time efficiency curve for one or more compressors of the plurality of compressors that are not currently in operation. In an embodiment, the capacity change operation includes initiating operation of at least one of the one or more compressors of the plurality of compressors that are not currently in operation. In an embodiment, the capacity change operation includes ceasing operation of at least one of the compressors of the chiller system that are currently in operation.

In an embodiment, the capacity change operation includes changing a load of at least one of the compressors of the chiller system that are currently in operation.

In an embodiment, each of the real time efficiency curves is a parabolic function.

In an embodiment, the controller is configured to determine a composite efficiency curve based on the efficiency curves for each of the plurality of compressors of the chiller system that are currently in operation, and the capacity change operation is based on the composite efficiency curve.

In an embodiment, the composite efficiency curve is further based on an efficiency curve for at least one compressor of the chiller system that is not currently in operation.

In an embodiment, the controller is configured to solve for a staging point, wherein the staging point defines when to initiate operation of a compressor not currently in operation or when to cease operation of a compressor currently in operation.

In an embodiment, chiller system comprising a plurality of compressors and the control system as described herein.

DRAWINGS

DETAILED DESCRIPTION

This disclosure is directed to systems and methods for modeling chiller efficiency in multi-chiller systems and controlling the chillers in use based on the modeled efficiency.

Figure 1:
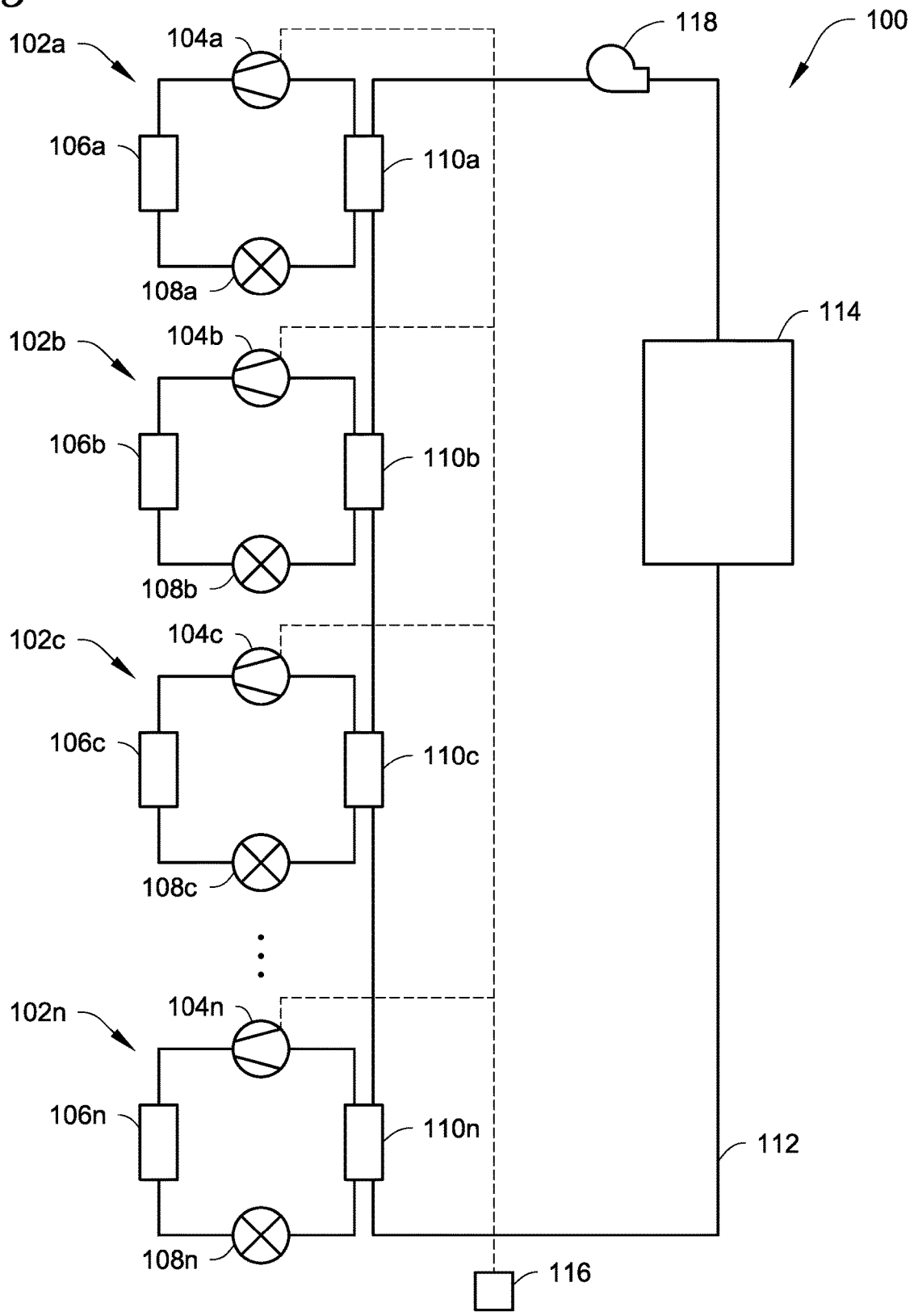
FIG. 1 shows a schematic of a chiller system according to an embodiment.

FIG. 1 shows a schematic of a chiller system according to an embodiment. Chiller system 100 includes a plurality of chiller circuits 102*a-n*. Each of chiller circuits 102*a-n* includes a compressor 104*a-n*, a condenser 106*a-n*, an expander 108*a-n*, and an evaporator 110*a-n*. Each of the evaporators 110*a-n* is configured to exchange heat with chiller process fluid line 112, such that any or all of evaporators 110*a-n* can absorb heat from the chiller process fluid line 112. Chiller process fluid line 112 is configured to convey chiller process fluid from chiller system 100 to a cooling load 114 and then back to the chiller system 100. A controller 116 can direct operation of each of the chiller circuits 102*a-n*.

Chiller system 100 is a chiller system for providing a chilled process fluid to provide cooling to a cooling load 114. Chiller system 100 includes a plurality of chiller circuits 102*a-n* each configured to absorb heat from the process fluid. Any number of the chiller circuits 102*a-n* can be actively cooling the process fluid at a particular time. In an embodiment, valves and fluid lines can be configured such that chiller circuits 102*a-n* which are not in operation can be bypassed. The process fluid can be, for example water, glycol, mixtures thereof, or any other suitable fluid for being cooled at chiller circuits 102*a-n* and absorbing heat at cooling load 114. The process fluid can include one or more additives to, for example, lower a freezing temperature of the process fluid.

Chiller circuits 102*a-n* are separate refrigeration circuits each configured to absorb heat from the process fluid. Chiller circuits 102*a-n* can be arranged with respect to flow of the process fluid in any of a series, parallel, or mixed arrangement including some chiller circuits 102*a-n* being in series and others in parallel. Each of chiller circuits 102*a-n* respectively include a compressor 104*a-n*, a condenser 106*a-n*, and expander 108*a-n*, and an evaporator 110*a-n*. In an embodiment, each of chiller circuits 102*a-n* can include identical components. In an embodiment, at least some of chiller circuits 102*a-n* differ in at least one component, such as the respective compressors 104*a-n* having different design and/or characteristics such as capacity or the like.

Each of compressors 104*a-n* are a compressor configured to compress a working fluid of the respective chiller circuit 102*a-n*. Each of compressors 104*a-n* can be any suitable compressor, such as, as non-limiting examples, a centrifugal compressor, a screw compressor, a scroll compressor, or the like. In an embodiment, each of compressors 104*a-n* are identical to one another. In an embodiment, each of compressors 104*a-n* can have different rated capacities and/or loading characteristics.

Each of condensers 106*a-n* is a heat exchanger that is configured to allow working fluid compressed by the respective compressor 104*a-n* to reject heat. The heat can be rejected to, as a non-limiting example, the ambient environment of that condenser 106*a-n* or to another fluid circuit such as for example for use in heat recovery.

Each of expanders 108*a-n* is configured to expand the working fluid after it has rejected heat at the respective condenser 106*a-n*. The expanders 108*a-n* can be any suitable structure or structures for expanding the working fluid, such as expansion valves, one or more expansion orifices, or the like.

Each of evaporators 110*a-n* is a heat exchanger that is configured to allow working fluid expanded at the respective expander 108*a-n* to absorb heat from process fluid of the chiller system 100. Each of evaporators 110*a-n* can be connected to the same stream of process fluid such that the process fluid is further cooled by each successive evaporator 110*a-n* that it passes through. In an embodiment, evaporators 110*a-n* can be connected to one another using combinations of fluid lines and valves that allow any of evaporators 110*a-n* to be selectively bypassed.

Chiller process fluid line 112 is a fluid line configured to convey process fluid from the chiller circuits 102*a-n* to the cooling load 114, and from cooling load 114 back to chiller circuits 102*a-n*. Cooling load 114 is one or more devices that reject heat to the process fluid. In embodiments, the cooling load 114 can be one or more terminal devices including heat exchangers, which are used to cool air within one or more conditioned spaces that are served by the chiller system 100.

Controller 116 is a controller configured to direct operation of chiller system 100, particularly operating particular compressors selected from among compressors 104*a-n*. Controller 116 can optionally further be configured to control valves directing process fluid of chiller system 100 such that it is routed only through those evaporators 110*a-n* of chiller circuits 102*a-n* that are currently in operation. Controller 116 can include one or more processors, one or more memories, one or more network input/outputs, and storage. It is understood that controller 116 can further include additional components. Controller 116 can be operatively connected to compressors 104*a*-n such that controller 116 can receive power consumption data and/or issue commands to the compressors 104*a-n*. Controller 116 can further be operatively connected to valves allowing process fluid to selectively bypass evaporators 110*a-n*. The operative connections can be any suitable wired or wireless connection allowing data and/or commands to be transferred to or from controller 116 and the connected compressors 104*a-n* and/or valves. Non-limiting examples of the operative connections include wired communications or wireless communications according any suitable known standard. In an embodiment, controller 116 can further control one or more pumps 118 included in chiller system 100, such as the pumps 118 circulating the process fluid between the cooling load 114 and chiller circuits 102*a-n*.

In an embodiment, controller 116 can be configured to map each of the compressors 104*a-n* to operate at various load points and various lift points in order to generate efficiency data. The efficiency data can be, for example, power consumption when operated at the predetermined lift and load points. Controller 116 can further be configured to store the resulting efficiency data for use in subsequent control of operations, for example using it to compute an efficiency curve such as a coefficient of performance which can be used to determine efficiency of that compressor under certain load and lift conditions. The efficiency data can be represented as parabolic curves of efficiency as a function of load under a particular lift condition.

In an embodiment, controller 116 can be configured to use efficiency models of the compressors 104*a-n* to control the staging of those compressors 104*a-n* to efficiently address cooling demand by cooling load 114. The controller 116 can use efficiency curves determined by operational testing as described above as the efficiency models, predetermined efficiency models, or any other suitable representation of the efficiency of compressors 104*a-n* as a function of lift and load. The controller 116 can receive a cooling demand for the cooling load 114. The cooling demand is a value representative of an amount of cooling that the chiller circuits 102*a-n* must provide to cool the cooling load 114. The cooling demand can, for example, be based on a desired leaving process fluid temperature for the chiller circuits 102*a-n* and a return process fluid temperature where it is returned from cooling load 114 to the chiller circuits 102*a-n* and subsequent flow of the process fluid. The efficiency models can be used to control operation of one or more of the compressors 104*a-n* in order to satisfy the cooling demand. In an embodiment, the control of the compressors 104*a-n* can include selecting loading levels for compressors 104*a-n* that are currently in operation. In an embodiment, the control of compressors 104*a-n* can include selecting one or more compressors 104*a-n* to operate. In an embodiment, the selection of the compressors to operate can include selecting one or more additional compressors from among compressors 104*a-n* to be operated alongside currently operated compressors among compressors 104*a-n*. In an embodiment, the selection of compressors can be based on composite efficiency curves. The composite efficiency curves can be determined based on a combination of efficiency curves for at least some of compressors 104*a-n*, such as currently operating compressors, currently operating compressors plus a next-to-add compressor, or currently operating compressors except for a next-to-subtract compressor. The selection of compressors to operate can be performed such that the selected compressors in operation reduce or minimize the energy consumption required to meet the cooling demand.

Figure 2:
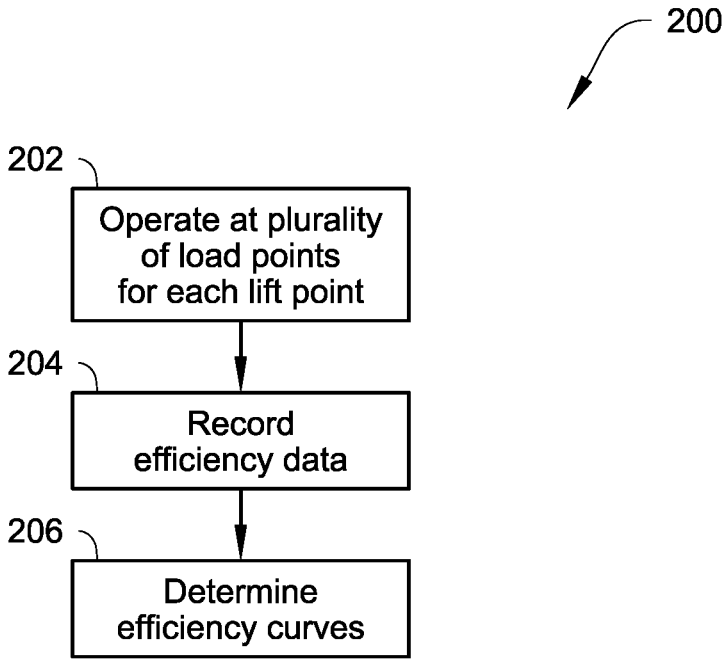
FIG. 2 shows a flowchart of a method for determining a model of a chiller according to an embodiment.

FIG. 2 shows a flowchart of a method for determining a model of a compressor according to an embodiment. Method 200 includes operating the compressor 202 at each of a plurality of load points within each of a plurality of lift points, recording efficiency data 204 at each of said plurality of load points within each of said plurality of lift points. The efficiency data used at 204 can be used to determine one or more efficiency curves 206 representative of the compressor efficiency under particular load and lift conditions.

The compressor to be modeled is operated at 202. The operation of the compressor 202 is performed at each of a plurality of various load points and at each of a variety of lift points. The operation at the various load and lift points can be operation at these varied load and lift points that occur over the course of ordinary operation of the compressor. In an embodiment, operation of the compressor may be directed to provide operation at lift and/or load points for which data is desired. The plurality of load points each are predetermined load levels for the compressor to be operated at. The plurality of lift points each represent different compressor lift conditions under which the compressor being modeled can be operated. The lift conditions can be characterized by the difference in temperature or pressure between a condenser and an evaporator of the circuit including the compressor.

Efficiency data is recorded at 204 for operation at each load point and respective lift point. The efficiency data can be, for example, a power consumption by the compressor being modeled when operated under the particular load and lift conditions. In an embodiment, the efficiency data is a coefficient of performance for the compressor.

Efficiency curves for the compressor being modeled can be determined for each lift point at 206. The efficiency curves can be used to model the efficiency of the compressor at various load levels for a variety of different lift points. In an embodiment, each efficiency curve is a discrete curve for a particular lift point. The efficiency curves for a particular compressor may vary in shape as the lift conditions vary. The efficiency curves can represent relationships between the compressor load and compressor efficiency under particular lift conditions. The efficiency curves can be parabolic curves. The method 200 can be performed with each compressor included in a chiller system, such as each of compressors 104*a-n* in chiller system 100 discussed above and shown in FIG. 1. The efficiency curves for the different load points can be used to determine the parameters defining the parabola of the efficiency curves for the respective lift points. The parabola can be a plot of efficiency, with the parabola providing a peak efficiency, a load at which the peak efficiency is achieved, and a width of the curve indicating the rate at which efficiency drops from the peak with changes in load.

Figure 3:
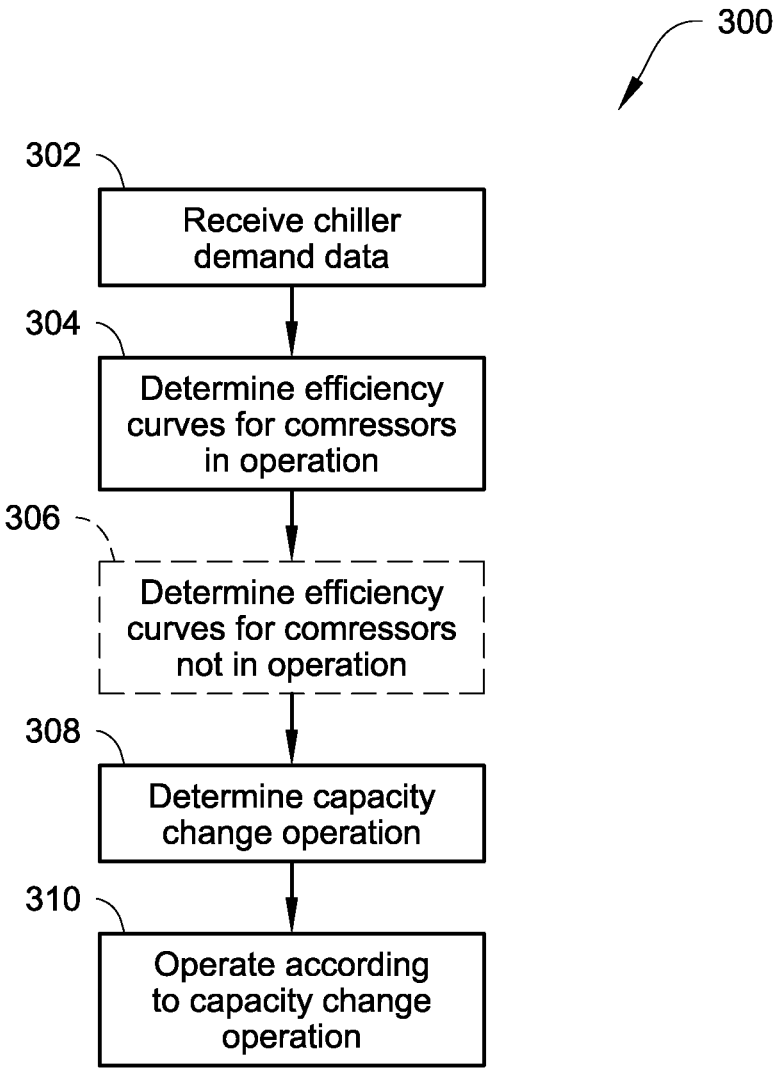
FIG. 3 shows a flowchart of a method for selecting chillers to use according to an embodiment.

FIG. 3 shows a flowchart of a method for selecting chillers to use according to an embodiment. Method 300 includes receiving chiller demand data 302, determining efficiency curves for each compressor currently being operated 304, optionally determining efficiency curves for one or more compressors not in operation 306, determining a capacity change operation 308, and operating the chiller system according to the capacity change operation 310.

Chiller demand data is received at 302. The chiller demand is a value indicative of the load required from the compressors to satisfy a cooling load, such as maintaining a leaving temperature for process fluid where it leaves the last of chiller circuits of the chiller system prior to being directed to the cooling load. In an embodiment, the chiller demand data can be based on a set point temperature and a process fluid temperature where the process fluid enters the first of chiller circuits or any other suitable point downstream of the cooling load and subsequent flow of the process fluid.

Efficiency curves are determined for compressors currently being operated at 304. The efficiency curves can be determined based on models of the compressors such as the models generated by way of method 200 described above and shown in FIG. 2. The models can be determined, for example, by using the current compressor lift conditions to determine the parameters of a function representative of the relationship between compressor load and compressor efficiency. In an embodiment, the function is a parabolic function. The efficiency curves determined at 304 can be determined based on the particular lift conditions for each respective compressor and using the relevant efficiency curve for that lift condition. In an embodiment, the efficiency curves determined at 304 can be combined into a composite efficiency curve. In an embodiment, the composite efficiency curve can omit one or more compressors that may be taken out of operation when responding to the chiller demand received at 302.

Optionally, efficiency curves can also be determined for compressors not currently being operated at 306. The efficiency curves can be determined for one or more compressors that are identified as potentially being activated to meet the chiller demand received at 302. The efficiency curves can be determined at 306 in the same manner as the efficiency curves are determined at 304 for the compressors currently being operated. In an embodiment, the efficiency curves can be determined at 306 by selecting the relevant efficiency curve for a predicted lift of the compressor if it is put into operation. In an embodiment, the efficiency curves determined at 306 can be combined into a composite efficiency curve also including the efficiency curves determined at 304.

A capacity change operation is determined at 308. The capacity change operation can be any suitable change in operation of the compressors in use to meet the chiller demand received at 302, for example by one or more of changing the loading of one or more compressors currently in operation, initiating operation of a compressor not currently in operation, or ceasing operation of a compressor currently in operation. The capacity change operation can be determined based on the efficiency curves determined at 304 and optionally at 306 to determine an efficient combination and/or operation of compressors to meet the chiller demand received at 302. The efficient combination can be a combination of compressors and their operations that provide increased efficiency and/or decreased energy consumption compared to other possible combinations or operations that can meet the chiller demand received at 302. In an embodiment, the efficient combination is one providing the greatest efficiency and/or the lowest energy consumption of combinations of compressors or operations thereof that meets the chiller demand received at 302. In an embodiment, the combinations of compressors for the capacity change operation can be determined by solving the system of equations defining the efficiency curves to identify staging points at which one or more specific compressors of the chiller system should initiate or cease operations.

The chiller system is operated according to capacity change operation 310. Compressors can be operated or cease operation to achieve the selection of compressors and/or the particular operations of compressors according to the capacity change operation determined at 308. A controller can issue commands directing the compressors of the chiller system to operate in accordance with the capacity change operation. The operation according to the capacity change operation can include ceasing operation of one or more compressors, initiating operation of one or more compressors, and/or selecting particular operational parameters such as speed, load, temperature set points, flow rates within the chiller system, or the like.

Figure 4:
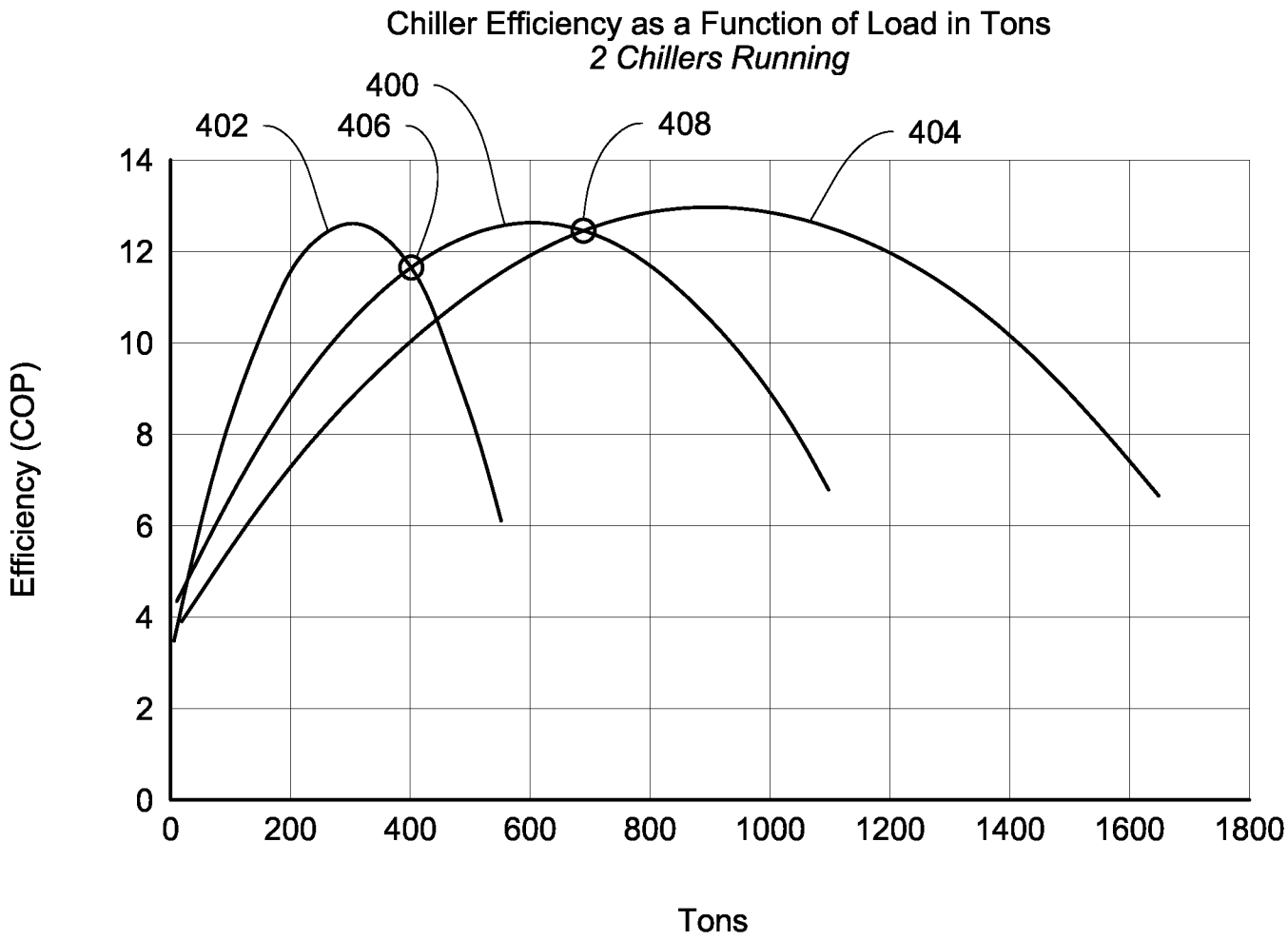
FIG. 4 shows an example of efficiency curves according to an embodiment including staging points.

FIG. 4 shows an example of efficiency curves according to an embodiment including staging points. In FIG. 4, efficiency is charted as a function of system load for a variety of chiller circuit operating possibilities. The efficiency measure used in FIG. 4 is the coefficient of performance (COP), and the load is provided in tons. It is understood that FIG. 4 is a representation of efficiency curves in general, and that particular values and positions of staging points can vary by system design, installation details, or any other suitable conditions that may affect particular load-efficiency relationships. Current operational curve 400 is a composite efficiency curve for the chiller system when the currently operating chiller circuits are in use. Reduced operations curve 402 is a composite efficiency curve for the chiller system when the currently operating chiller circuits are in use, except for a next-to-subtract chiller for which operation is ceased. Increased operations curve 404 is a composite efficiency curve for the chiller system when the currently operating chiller circuits and a next-to-add chiller circuit are in use. Each of the current operational curve 400, reduced operations curve 402, and increased operations curve 404 can be determined based on efficiency curves determined for each of the compressors, for example by way of the method shown in FIG. 2 and described above. Determination of the composite efficiency forming each of curves 400, 402, 404 can be according to the determination of composite efficiency curves described herein.

A chiller subtraction staging point 406 can be present at the intersection where the current operational curve 400 and the reduced operations curve 402 cross one another. At loads below the chiller subtraction staging point 406, efficiency of the chiller system as a whole, is higher when the next-to-subtract chiller circuit ceases operation. Accordingly, the chiller subtraction staging point 406 can be used to control the chiller system by ceasing operation of the next-to-subtract chiller when load is at or will be lower than the chiller subtraction staging point. In embodiments, the chiller subtraction staging point 406 and/or the curves 400 and 402 from which the chiller subtraction staging point 406 is determined can be dynamically calculated to reflect recent performance for each chiller circuit or compare different combinations of chiller circuits.

Chiller addition staging point 408 can be present at the intersection where the current operational curve 400 and the increased operations curve 404 cross one another. At loads above the chiller addition staging point 408, efficiency of the chiller system as a whole is greater when the next-to-add chiller circuit is added to the chiller circuits currently in operation. Accordingly, the chiller addition staging point 408 can be used to control the chiller system by initiating operation of the next-to-add chiller when the load is or will exceed the chiller addition staging point 408. In embodiments, the chiller addition staging point 408 and/or the curves 400 and 404 from which the chiller addition staging point 408 is determined can be dynamically calculated to reflect recent performance for each chiller circuit or compare different combinations of chiller circuits.

ASPECTS

It is understood that any of aspects 1-10 can be combined with any of aspects 11-20.

Aspect 1. A method of operating a chiller system including a plurality of compressors, the method comprising:
receiving a chiller demand;
determining a real time efficiency curve for each of the plurality of compressors of the chiller system that are currently in operation;
determining a capacity change operation based on the efficiency curves and a chiller demand; and operating the chiller system according to the capacity change operation.

Aspect 2. The method according to aspect 1, further comprising determining a real time efficiency curve for one or more compressors of the plurality of compressors that are not currently in operation.

Aspect 3. The method according to aspect 2, wherein the capacity change operation includes initiating operation of at least one of the one or more compressors of the plurality of compressors that are not currently in operation.

Aspect 4. The method according to any of aspects 1-3, wherein the capacity change operation includes ceasing operation of at least one of the compressors of the chiller system that are currently in operation.

Aspect 5. The method according to any of aspects 1-4, wherein the capacity change operation includes changing a load of at least one of the compressors of the chiller system that are currently in operation.

Aspect 6. The method according to any of aspects 1-5, wherein each of the real time efficiency curves is a parabolic function.

Aspect 7. The method according to any of aspects 1-6, wherein determining the capacity change operation includes determining a composite efficiency curve based on the efficiency curves for each of the plurality of compressors of the chiller system that are currently in operation.

Aspect 8. The method according to aspect 7, wherein the composite efficiency curve is further based on an efficiency curve for at least one compressor of the chiller system that is not currently in operation.

Aspect 9. The method according to any of aspects 1-8, wherein determining the capacity change operation includes solving for a staging point, wherein the staging point defines when to initiate operation of a compressor not currently in operation or when to cease operation of a compressor currently in operation.

Aspect 10. The method according to any of aspects 1-9, further comprising obtaining selection data by measuring efficiency data for each of the plurality of compressors at each of a plurality of load points within each of a plurality of lift points, wherein determining the real time efficiency curves is based on the selection data.

Aspect 11. A control system for a chiller system including a plurality of compressors, the control system, comprising: a controller configured to:

receive a chiller demand;

determine a real time efficiency curve for each of the plurality of compressors of the chiller system that are currently in operation;

determine a capacity change operation based on the efficiency curves and a chiller demand; and direct operation of the chiller system according to the capacity change operation.

Aspect 12. The control system according to aspect 11, wherein the controller is further configured to determine a real time efficiency curve for one or more compressors of the plurality of compressors that are not currently in operation.

Aspect 13. The control system according to aspect 12, wherein the capacity change operation includes initiating operation of at least one of the one or more compressors of the plurality of compressors that are not currently in operation.

Aspect 14. The control system according to any of aspects 11-13, wherein the capacity change operation includes ceasing operation of at least one of the compressors of the chiller system that are currently in operation.

Aspect 15. The control system according to any of aspects 11-14, wherein the capacity change operation includes changing a load of at least one of the compressors of the chiller system that are currently in operation.

Aspect 16. The control system according to any of aspects 11-15, wherein each of the real time efficiency curves is a parabolic function.

Aspect 17. The control system according to any of aspects 11-16, wherein the controller is configured to determine a composite efficiency curve based on the efficiency curves for each of the plurality of compressors of the chiller system that are currently in operation, and the capacity change operation is based on the composite efficiency curve.

Aspect 18. The control system according to aspect 17, wherein the composite efficiency curve is further based on an efficiency curve for at least one compressor of the chiller system that is not currently in operation.

Aspect 19. The control system according to any of aspects 11-18, wherein the controller is configured to solve for a staging point, wherein the staging point defines when to initiate operation of a compressor not currently in operation or when to cease operation of a compressor currently in operation.

Aspect 20. A chiller system comprising a plurality of compressors and the control system according to any of aspects 11-19.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of operating a chiller system including a plurality of compressors, the method comprising:

receiving a chiller demand;

determining a real time efficiency curve for each of the plurality of compressors of the chiller system that are currently in operation;

determining a capacity change operation based on the efficiency curves and a chiller demand; and operating the chiller system according to the capacity change operation.

2. The method of claim 1, further comprising determining a real time efficiency curve for one or more compressors of the plurality of compressors that are not currently in operation.

3. The method of claim 2, wherein the capacity change operation includes initiating operation of at least one of the one or more compressors of the plurality of compressors that are not currently in operation.

4. The method of claim 1, wherein the capacity change operation includes ceasing operation of at least one of the compressors of the chiller system that are currently in operation.

5. The method of claim 1, wherein the capacity change operation includes changing a load of at least one of the compressors of the chiller system that are currently in operation.

6. The method of claim 1, wherein each of the real time efficiency curves is a parabolic function.

7. The method of claim 1, wherein determining the capacity change operation includes determining a composite efficiency curve based on the efficiency curves for each of the plurality of compressors of the chiller system that are currently in operation.

8. The method of claim 7, wherein the composite efficiency curve is further based on an efficiency curve for at least one compressor of the chiller system that is not currently in operation.

9. The method of claim 1, wherein determining the capacity change operation includes solving for a staging point, wherein the staging point defines when to initiate operation of a compressor not currently in operation or when to cease operation of a compressor currently in operation.

10. The method of claim 1, further comprising obtaining selection data by measuring efficiency data for each of the plurality of compressors at each of a plurality of load points within each of a plurality of lift points, wherein determining the real time efficiency curves is based on the selection data.

11. A control system for a chiller system including a plurality of compressors, the control system, comprising:

a controller configured to:

receive a chiller demand;

determine a real time efficiency curve for each of the plurality of compressors of the chiller system that are currently in operation;

determine a capacity change operation based on the efficiency curves and a chiller demand; and direct operation of the chiller system according to the capacity change operation.

12. The control system of claim 11, wherein the controller is further configured to determine a real time efficiency curve for one or more compressors of the plurality of compressors that are not currently in operation.

13. The control system of claim 12, wherein the capacity change operation includes initiating operation of at least one of the one or more compressors of the plurality of compressors that are not currently in operation.

14. The control system of claim 11, wherein the capacity change operation includes ceasing operation of at least one of the compressors of the chiller system that are currently in operation.

15. The control system of claim 11, wherein the capacity change operation includes changing a load of at least one of the compressors of the chiller system that are currently in operation.

16. The control system of claim 11, wherein each of the real time efficiency curves is a parabolic function.

17. The control system of claim 11, wherein the controller is configured to determine a composite efficiency curve based on the efficiency curves for each of the plurality of compressors of the chiller system that are currently in operation, and the capacity change operation is based on the composite efficiency curve.

18. The control system of claim 17, wherein the composite efficiency curve is further based on an efficiency curve for at least one compressor of the chiller system that is not currently in operation.

19. The control system of claim 11, wherein the controller is configured to solve for a staging point, wherein the staging point defines when to initiate operation of a compressor not currently in operation or when to cease operation of a compressor currently in operation.

20. A chiller system comprising a plurality of compressors and the control system according to claim 11.

* * * * *